United States Patent [19]

Carnes

[11] 3,930,352

[45] Jan. 6, 1976

[54] PACKAGING MACHINE

[75] Inventor: Roy W. Carnes, Richmond, Va.

[73] Assignee: AMF Incorporated, White Plains, N.Y.

[22] Filed: Apr. 22, 1974

[21] Appl. No.: 462,896

[30] Foreign Application Priority Data

July 25, 1973 United Kingdom ..... 35342/73

[52] U.S. Cl. ..... 53/189; 53/384

[51] Int. Cl.[2]...B65B 5/00; B65B 43/26; B65B 57/04

[58] Field of Search ..... 53/187, 189, 190, 191, 53/384, 385, 67, 261, 255, 258, 259; 214/8.5 A; 221/106

[56] References Cited

UNITED STATES PATENTS

| | | | |
|---|---|---|---|
| 2,608,331 | 8/1952 | Hoffman | 53/261 |
| 3,391,519 | 7/1968 | Keenan, Jr. et al. | 53/189 |
| 3,440,801 | 4/1969 | Prince et al. | 53/189 |
| 3,478,490 | 11/1969 | Sylvester et al. | 53/189 |
| 3,504,784 | 4/1970 | Noyes | 53/187 X |
| 3,527,337 | 9/1970 | Formo | 53/259 X |
| 3,556,316 | 1/1971 | Marasso et al. | 53/385 X |
| 3,590,553 | 7/1971 | Formo | 53/189 |
| 3,618,292 | 11/1971 | Rademacher | 53/261 X |
| 3,750,721 | 8/1973 | Hudson | 53/187 X |

*Primary Examiner*—Travis S. McGehee
*Assistant Examiner*—Horace M. Culver
*Attorney, Agent, or Firm*—George W. Price; Martin Smolowitz

[57] ABSTRACT

An apparatus for packaging bread or the like into flexible bags, employing articulated scoops which are arranged to enter into the bag interior, engage the bag wall surfaces, and enable passage of product into the bag through the scoops. Pusher arm assemblies are employed to urge the continuous forward travel of product. A sensing device i.e. photo-electric cell, is employed to detect the absence of packaging bags and cause activation of a fresh supply of bags into the packaging station.

2 Claims, 11 Drawing Figures

PACKAGING MACHINE

The present invention is directed to an apparatus for automatically advancing and packaging bread and the like, into packaging material in an efficient and trouble free manner. More particularly, the present invention is directed to an apparatus for guiding and advancing the material to be packaged into a plastic bag which is held in the open position by suitably structured guide means. Also within the scope of the present invention is a system for sensing the absence of a bag to receive the article being advanced thereon and associated means for replenishing the bags with a fresh supply.

Generally speaking it is most desirable to have a versatile packaging machine that is capable of bagging different sizes and shapes either loosely or in boxes; in clusters or singularly; sliced or unsliced, etc. This can be accomplished by employing suitably designed perameters in a basic machine structure. The prior art has employed structure which carries out some of the operations of the invention but without the attendent advantages.

However, the specific concepts utilized in carrying out the invention represent a new and novel approach which is less expensive, more efficient, less complicated, easier to use, has greater utility and represents an advance in the art of automatic packaging.

Accordingly it is the main object of the present invention to provide an apparatus free from the defects of the prior art.

Still another object of the present invention is to provide a guiding assembly adapted to positively engage the product to be packaged for advance into the bag.

Still a further object of the present invention is to provide an efficient articulated scoop mechanism suitably adjustable for entering, positioning and cooperating with the bag to receive the product to be packaged.

Still another object of the present invention is to provide a sensing arrangement adapted to sense upon the absence of the supply of bags and coordinate the arrival of a fresh supply of the continued infeed of product to be packaged.

Still a further object of the present invention is to provide for a ready adjustable packaging machine capable of holding different varieties and sizes of product to be packaged.

The principal feature of the present invention is directed to a packaging apparatus for successively receiving and packing a supply of material such as baked goods into each of a stack of bags including: means for advancing said material into a packaging conveyor; conveying means for conveying said material into a packaging station; means for causing said bag to become partially opened; engaging means for entering and engaging bags for receiving said material to be packaged; advancing means for advancing said material through said engaging means into the interior of said bags for sealing; means sensing the successive utilization of bags from said stack to thereby advance fresh packaging material as said bags are being used; and drive means for advancing a fresh stack of packaging material into said packaging station as the last of said bags is used.

Also within the scope of the invention are engaging means including a pair of cooperatively acting elongated guide means adapted to enter into said partially opened bags and engage the interior at the wall surface to thereby allow sufficient passage area for material to be advanced therethrough and into the package interior; and means for urging said guide means to assume a collapsed retracted position as said material is caused to fill the previously existing void in said package.

The invention also contemplates bag supply means having, a stack of packaging material; support means for holding said packaging material to be dispensed as required; restraining means disposed in proximity with respect to said packaging material for holding said packaging material in horizontal alignment with respect to said product being inserted therein by said pusher arms; drive means for positioning said support means to allow for the withdrawal of said packaging material and cam means for advancing said support means back into horizontal alignment with said product flow after said filled packaging material has been removed from a stack.

Still other objects and advantages of the present invention will be best understood with reference to the accompanying specification and drawings together with the claims which hereinafter define the invention.

Figure 8A:
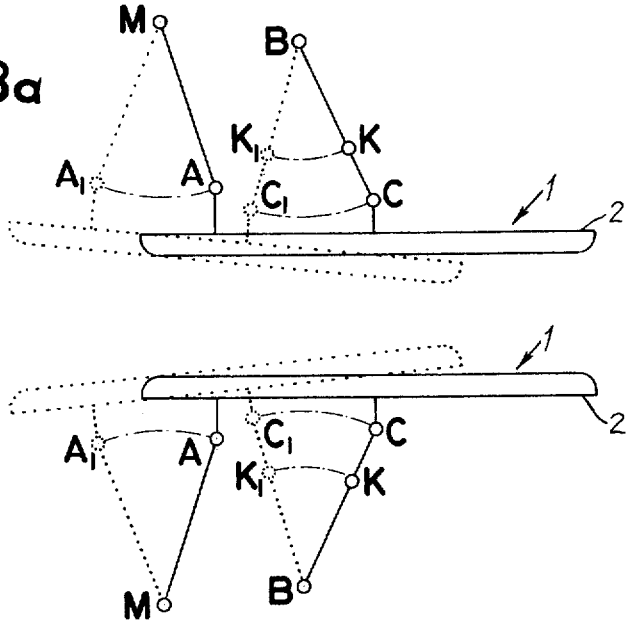

FIG. 8*a* is a top view of a schematic diagram illustrating the movement of the scoops employed in the invention.

Figure 8B:
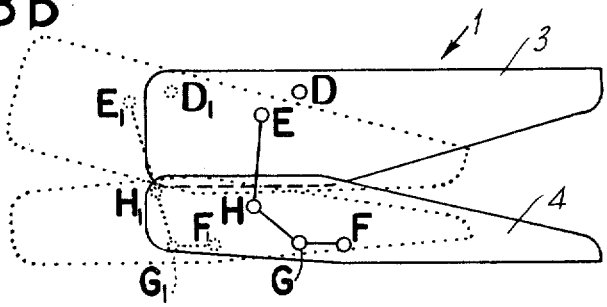

FIG. 8*b* is a profile view of FIG. 8*a*.

Figure 8C:
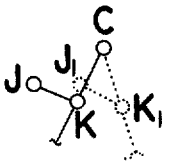

FIG. 8*c* is a point diagram showing the pivotal scoop movement.

Figure 8D:
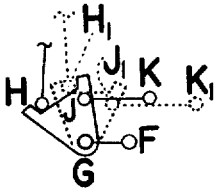

FIG. 8*d* is a schematic diagram illustrating the locking action of the scoops in accordance with the invention.

As product is being advanced along suitable means such as a conveyor, it is caused to interrupt a photoelectric light source, and initiate an air flow through a plurality of suitably disposed air jets. This last action causes the uppermost bag in the stack to inflate. Once this occurs, articulated scoops are fully withdrawn and folded into a low and narrow profile for entry into the inflated bag. Simultaneous with this occurrence and product advance by means of the overhead pusher guides; the scoops in the aforementioned position, that is in the folded position, are urged into the open mouth of the inflated bag. Once disposed therein, the scoops are caused to unfold, engage and grip the bag, so as to shape such inflated bag into a suitable size for product entry therethrough. Thereafter, the overhead pusher guide proceeds to literally push the product through the scoops and into the open mouth of the bag.

The scoop arrangement is basically a cam actuated articulated scoop mechanism for use with relatively narrow bread products of substantially square cross section. To permit utilization with a wide range of bag and product configuration, the scoops, as hereinafter described are fully adjustable over a wide range. The basic operation allows a cam operated scoop mechanism to provide the desired motion characteristics of such scoop so as to aid its entry into and expansion of the bag at the appropriate time enabling product entry. Conversely, in the retracted position, the discharge end of the scoops are fully folded into a narrow low profile ready for entry into the open mouth of the bag. Inherent to the inventive design, is the fact that a low narrow profile permits slow and deep penetration of the scoops sufficiently into the interior of the bag prior to the scoops fully opening up to grip the bag and guide the product into the bag.

Figure 3:
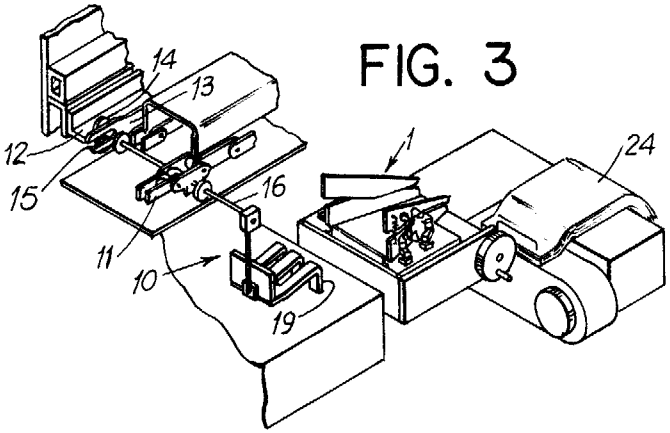
FIG. 3 is a partial schematic view of the invention illustrating the pusher, scoopes and bag replenisher.
Figure 4:
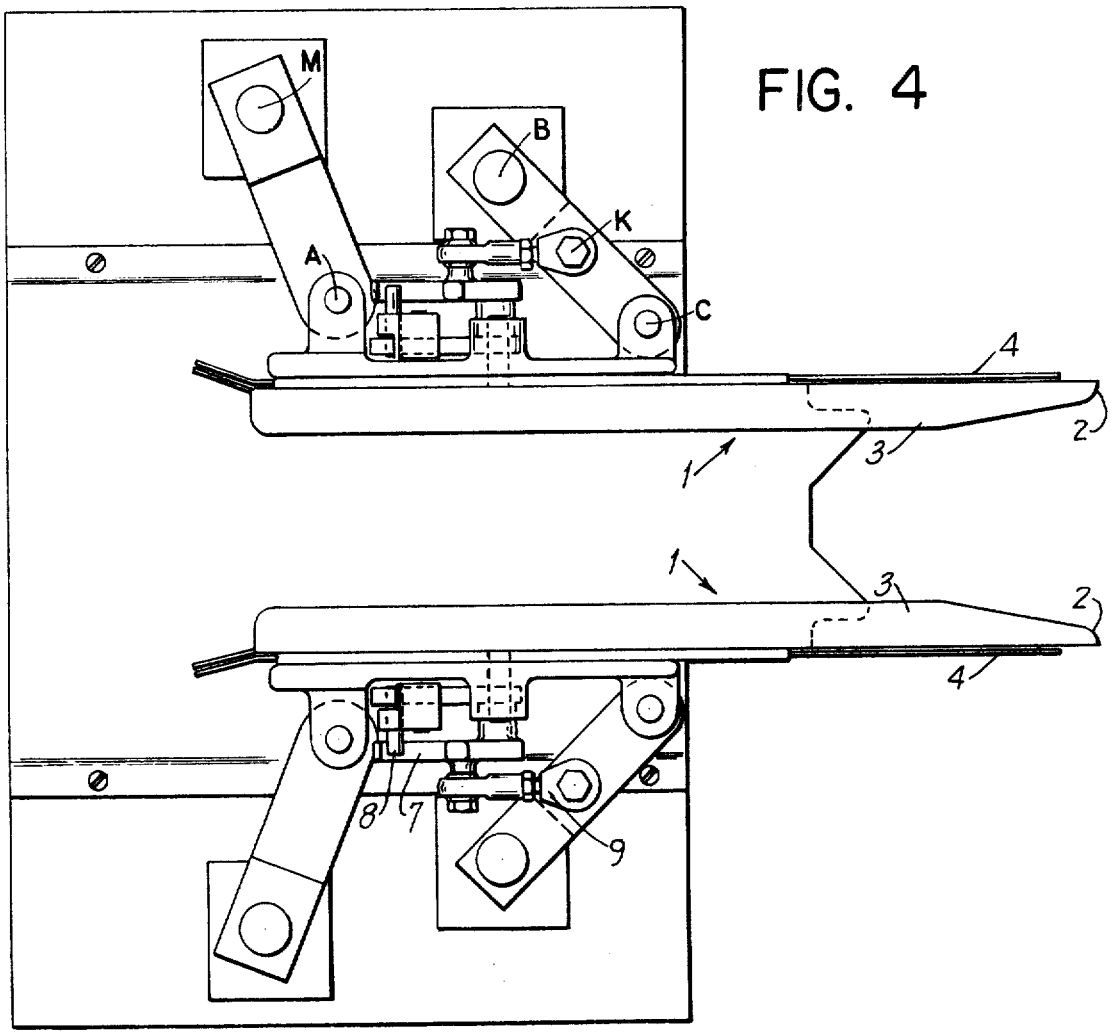
FIG. 4 is a top view of the scoopes in the open position.
Figure 5:
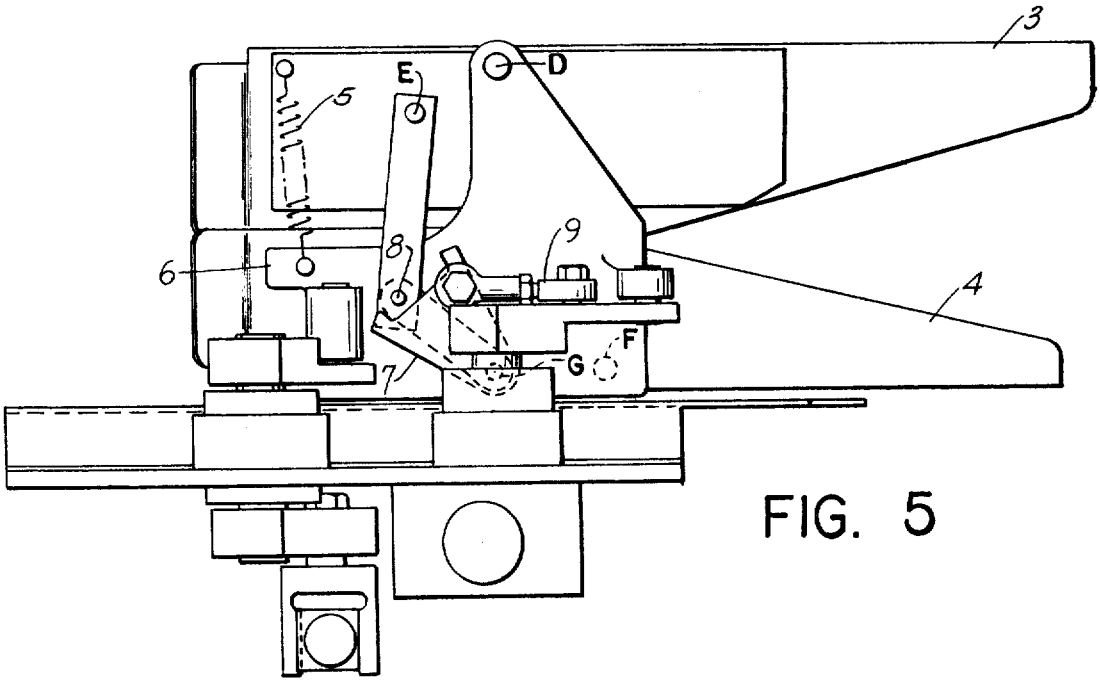
FIG. 5 is a side elevation of scoopes shown in FIG. 4.

The scoop mechanism can be best understood with reference to FIGS. 3, 4 and 5.

Firstly, the use of the term scoop mechanism or scoops is intended to cover the assembly which is actuated and is caused to enter a partially opened mouth of a bag, complete the opening of the bag and thereafter serve as a channel or funnel for insertion of the article to be bagged therethrough. While mechanisms of this type are known and in its simplist form consists of a tapering tube with the small end inserted into the bag and articles introduced through the large end; the usual embodiment known to the art, proceeds to employ a mechanism which splits the funnel into sections causing the leading ends to be drawn together during entry into the bag. Once the mechanisms have entered into the bag, the tips are moved apart to increase the size of the opening to a maximum. However, this arrangement has certain number of limitations, especially where the article to be bagged is relatively rigid, for example, a loaf of bread. In such cases, it is desirable to employ a channel or funnel exhibiting double articulation, that is the elements of the funnel being split into four sections thereby enabling the tips or working edges to be drawn together both vertically and horizontally, so that the scoop can enter into the bag rapidly and more particularly without the need for the bag to be opened to an amount that is normally required when employing a single articulated scoop. The advantages of such articulated scoops are well established. However, the manner in which the various movements of the scoop elements are effectuated, and the overall efficiency exhibited by the present invention can be understood with reference to FIG. 8.

In accordance with the invention, the scoops 1 are shown in the forward position, as for instance, when they are inserted into the mouth of a bag and the working edges 2 are in the extended position. Conversely, the retracted position, as represented by broken lines, cause the tips or working edges 2 to be drawn together. Likewise, FIGS. 4 and 5 illustrate the scoop working edges 2 in the expanded position when forward and in a closed position when retracted.

In FIG. 8, points A and C are pivot points. In operation, points A on each scoop 1 are urged to move in an arc defined by $A_1$ to A and points C move in an arc about fixed points B. The link B-K-C is a rigid bar whose principle function is to force points C to move in an arcuate path $C_1$-C. From this, it is readily apparent that the path described, causes the scoop working edges or tips 2 to initially converge and then diverge in moving from a retracted position to a forward position. In accordance with FIG. 8*b*, the upper and lower elements 3, 4 of the scoop 1 are pivotally mounted at points D and F respectively. A toggle linkage connects the upper and lower elements which is identifiable as E-H and H-G. From this it is quite apparent that in the retracted position where the toggle pivot points $E_1$ and $G_1$ are urged or pushed apart causing the scoop 1 to turn about pivot points $D_1$ and $F_1$ causing the working edge or tip 2 of the lower element 4 to rise and the working edge or the tip 2 of the upper element 3 to lower. Suitably connected springs 5 (see FIG. 5) extending from each scoop element 3, 4 to a mounting plate 6 causes such scoop elements 3, 4 to be biased toward the expanded state, as shown in FIG. 5.

In accordance with FIG. 8*b*, during the retraction stroke of the scoops 1, the toggle linkage is caused to move from its folded state E-H-G and assume a near straight line position $E_1$-$H_1$-$G_1$ against the bias of the springs 5 thereby causing and urging the scoop tips 2 to converge. The linkage is caused to latch in its near straight position by causing point H to be advanced past the line of centers against a stop.

More particularly, this operation can be understood with reference to schematic FIGS. 8*c* and 8*d*. In accordance with FIG. 8*d*, points G, F and H are represented and a yoke member 7 (see FIG. 5) carrying point J is pivotally mounted at G as is the member H-F of FIG. 8*d*. However, the two elements are independendently rotatable. What follows is that during the retraction stroke of the scoops 1, the yoke member 7 is caused to rotate about point G in the clockwise direction. The left most tine of the yoke 7 engages a pin 8 at H which pin is carried by member H-G and thusly causes such member H-G to rotate about point G.

Member H, E is caused to rotate about a point E in the counterclockwise direction causing the point H to be moved through the line of centers E-G whereby the toggle linkage latches. During the forward stroke of the scoops 1 the yoke member 7 is caused to rotate opposite to or in the counterclockwise direction and just prior to the scoops 1 reaching the full forward position, the right most tine of the yoke 7 contacts the pin 8 at H causing it to be pushed through the line of centers resulting in a unlatching of the toggle linkage. Due to the spring 5 bias, the toggle elements fold and the scoop tips or working edges 2 move apart. The motion of the lower scoop element 4 is restricted to a small amount by suitable stop members (not shown). However, the upper element 3 is permitted a greater range of motion with its raised position usually being dictated by the tension of the bag imparted thereto.

Connecting link J-K as shown in FIG. 8*c* and 8*d* causes the yoke 7 to move with K being located on the member BKC of FIG. 8*a* and J located on yoke 7. With point B fixed, motion of point C during the retraction stroke causes a relative rotation of point K and C in a counterclockwise direction, which through connecting link J-K causes the yoke 7 to rotate about point G in a clockwise direction (see FIG. 8*d*).

Referring to FIG. 8*a*, each half of the scoop assembly moves back and forth on arms M-A and B-C. These arms rotate about grounded points M and B, but they have relative rotation about points A and C. Point K, carried on arm B-C, therefore, has relative rotation about point C as shown on FIG. 8*c*. A yoke member 7 rotatable about a horizontal axis at G (FIG. 8*d*), is caused to oscillate, as the scoops go back and forth, by a link 9 connecting point K (on arm B-C) to point J, on the yoke 7 (see FIG. 8*d*). The tines of the yoke 7 alternately engage pin 8, carried on toggle linkage G-H-E at H, and on the back stroke forces point H into a straight line with G and E as shown at $E_1$-$H_1$-$G_1$ FIG. 8*b* where the toggle is latched.

This expanding action of the toggle linkage causes the scoop tips 2 to be forced together against the bias of spring 5.

On the forward stroke, the yoke 7 pushes point H off center, which unlatches it, and under the pressure of the spring 5 resumes the folded position as at E-H-G, FIG. 8*b*, and the scoop tips 2 are permitted to move apart.

Thus, in the foregoing manner, the scoop tips 2 are latched closed during the back stroke and just at the end of the forward stroke, when the tips 2 are completely in the bag, the toggle is unlatched and the tips 2 fly apart to the open position.

By means of the aforementioned arrangement and sequence of operations, the entire back stroke of the scoop 1 is used to cam the tips or working edges 2 together while full insertion of the scoops 1 into the bag is accomplished before the scoops 1 are caused to spring and extend into an open position.

Figure 1:
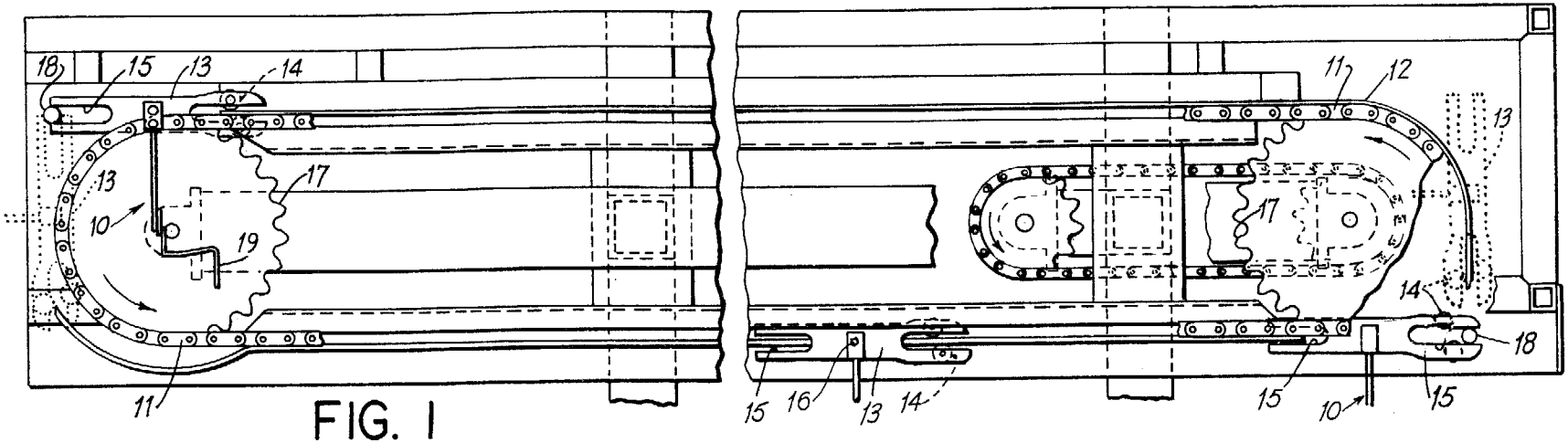
FIG. 1 is a side elevation of conveyor and pusher assembly in partial fragmented view.
Figure 2:
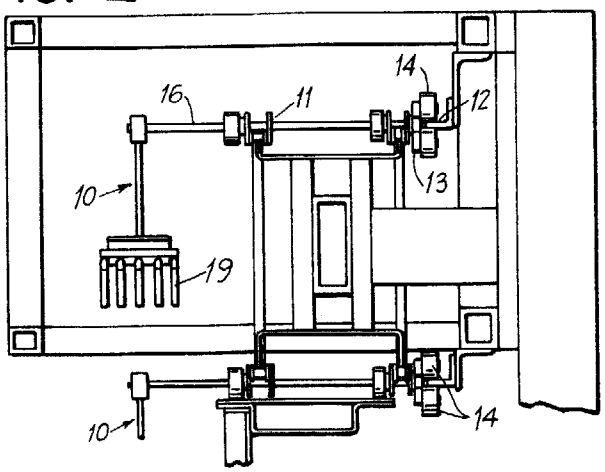
FIG. 2 is a sectional view through the conveyor and pusher assembly.

As shown in FIGS. 1 and 2, the apparatus of the present invention contemplates a series of overhead pushers 10 which are continuously moved. Each pusher 10 is pivotally mounted on a pair of chains 11 and are constrained and guided by means of cam tracks 12 working in conjunction with pusher control arms 13. In this connection, it is desirable to employ such pushers 10 in a manner enabling the material to be pushed into the bag to a forward-most position, whereupon the pusher 10 can retract away from the material. Such is the case with the continuous motion of a carrier chain 11, where in accordance with the needs of the invention, a loaf of bread is advanced into the bottom of a bag from which point the pusher 10 is withdrawn from inside the bag mouth.

The combination of pivotally mounted overhead pushers 10 continuously traversing on a pair of chains 11, as well as, control pusher acceleration at the end of the idle travel and the end of the product pushing travel, permits smooth high speed operation of the apparatus.

In FIG. 1, pusher arms 10 are carried and are continuously in motion while traveling at a constant rate along the path defined by a carrier chain 11. A control arm 13 is rigidly mounted on each rotatable shaft which carries the pusher arms 10. Rollers 14 carried on the control arms 13 ride on either side of a track 12 which tends to stabilize the assembly, thereby minimizing rotation during both upper and lower horizontal motion. The control arms 13 each are provided with a slot 15 at each end. For purposes of illustration, reference is made to the lower run, as the pusher shaft 16 reaches tangency to the drive sprockets 17, the leading slot engages a fixed pin or roller 18. Simultaneously, the control arm rollers 14 lose contact with the control arm track 12 and as the pusher shaft 16 moves around the sprocket 17, the control arm 13 is caused to rotate about the fixed pivot pins 18. Thus, the face of the pusher 19 is caused to swing back away from its forwardmost position. By the time the pusher shaft 16 reaches the horizontal center line of the sprocket 17, the pusher control arm 13 is vertical and the slot 15, trailing now, is leaving contact with the pivot pin 18. Also, at this time, a curved extension of the upper control arm track 12 is being contacted by the control arm rollers 14 and guides the assembly around the remaining quadrant.

The upper control arm track 12 stabilizes the pusher assembly as it approaches the left-most drive sprocket 17. As the pusher shaft 16 reaches tangency to the sprocket 17, the control arm rollers 14 travel off the track 12 and the leading slot 15 in the control arm 13 engages another pivot pin or roller 18. Here again, the pusher assembly rotates about the pivot pin 18 as the pusher shaft 16 moves around the sprocket. By the time the pusher shaft 16 reaches the horizontal center line of the sprocket 17 the pusher control arm 13 is vertical and the slot is leaving engagement with the upper pivot pin 18 and the rollers 14 are engaged with the lower track 12 provided with a curved extension that wraps partially around the sprocket 17.

Figure 6:
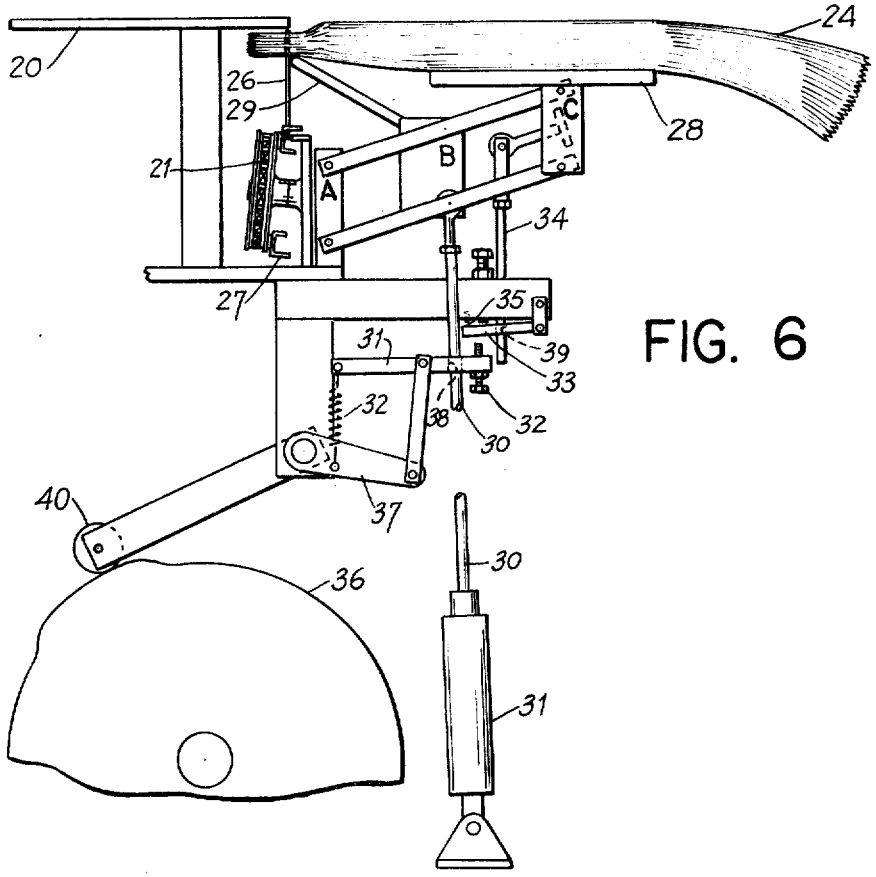
FIG. 6 is a partial side elevation of the bag replenisher assembly.
Figure 7:
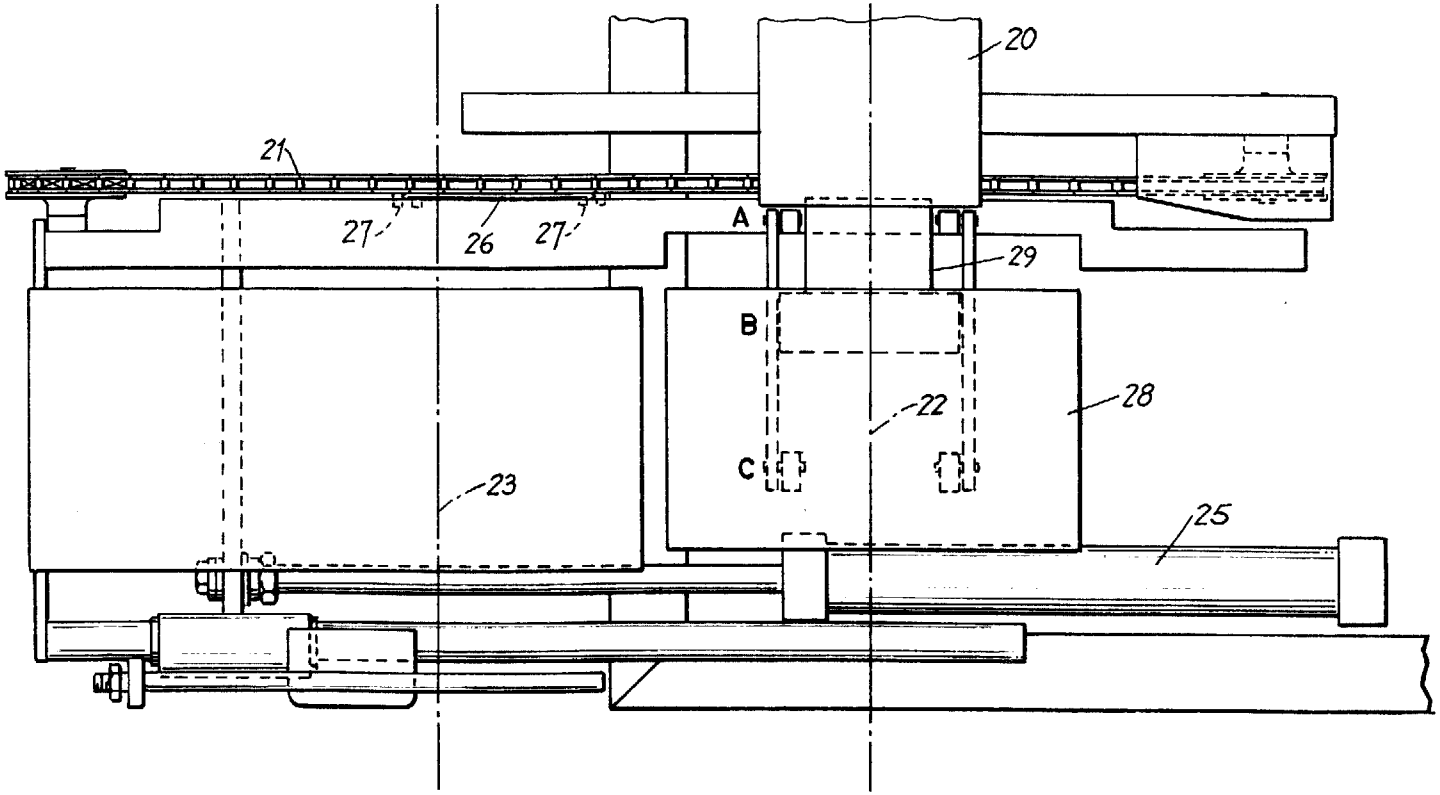
FIG. 7 is a top view of the bag replenisher section shown in FIG. 6.

By way of further explanation, to eliminate the possibility of feeding loaves of bread or the like without appropriate bags, it is accepted practice to supply bags which are pre-made bags with extended lips containing suitable punched holes for holding a group of bags in substantial quantities, i.e. 500 to 750 on a wicket wire. In order to minimize interruption of production and to maintain a continuous flow of product bagging, the present invention contemplates a bag resupply arrangement, as shown in FIGS. 6 and 7. This assembly employs a pair of endless roller chains 21 transversed to the direction of product flow. The chains 21 comprise function in two locations, namely, at a use or filling station 22 and a standby station 23.

The wickets of bags 24 are held in line with product flow in a position ready to be inflated and loaded by action of the overhead pusher 19. Another wicket of bags 24 are in the standby position 23 located outside the product flow path. The pitch or spacing between these two positions is equal to the maximum width of the bag to be accommodated, plus a small amount of clearance between such bag stations 22, 23.

The present assembly employes an indexing arrangement for indexing the bag resupply chains 21 which makes use of a fixed stroke pneumatic cylinder 25 with a ratchet connection to the chains 21 so that uni-directional motion can be imparted to index the bags by an amount equal to the pitch selected between the use position and the reserve position. The wicket wires 26 are held by clips 27 affixed to the chain 21 located under the open end of the wicket of bags 24.

The bags 24 being utilized are supported in the use position by a bag support table 28 and are held secure during the filling function by pressure of lip pressure bar 29 gripping the bag lip. In accordance with FIGS. 6 and 7, the bag support table 28 is mounted on a parallelogram linkage of arm length A-C and the lip pressure bar 29 is carried by another linkage of arm length A-B with coincident centers of rotation at A.

The clutch rod 30 is attached to the lip pressure bar linkage A-B which abutts the table linkage A-C causing both parallelogram linkages to lift by lifting action of the clutch rod 30, however, the table linkage A-C may be lifted independently, or held in a raised position when the lip pressure bar 29 is lowered. For bag transfer purposes, when the air cylinder 31 operates to move the lip pressure bar 29, it and the bag support table 28 moves in unison, except arm A-B being half as long as arm A-C, the motion of the lip pressure bar 29 is one-half that of the bag support table 28. This relationship reflects that the bag stack thickness on the support table 28 is twice that at the lip; and as each top bag is removed, the table rises two film thicknesses while the lip rises one film thickness. The upper portion of the table 28 and lip pressure bar 29 is determined by the latter bottoming against the stack of film at the lip.

Rod 30 connecting the lip pressure bar 29 to the air cylinder 31, passes through a close fitting hole 38 in arm 31, which under the bias of spring 32 tends to "cock" which, in turn, causes a gripping force on rod 30 unless arm 31 is held square by screw 32 striking a stop which is arm 33. A similar clutching means is obtained with rod 34, attached to support table 28, passing through a hole 39 in arm 33 biased to cock by compression spring 35.

As the rotation of the cam 36 causes the bell crank 37 to pull down on arm 31, it cocks, gripping rod 30 and causing it to move down bringing with it the lip pressure bar 29 which releases its pressure on the lips of the bags. The support table 28 is prevented from following the pressure bar 29 down by the gripping action of arm 33 exerted on rod 34 attached to bag support table 28. At all times, except when the cam follower 40 is on the raised portion of the cam 36, both arms 31 and 33 are held square to their respective rods 30, 34 and such rods can freely slide in holes 38, 39 permitting the air cylinder 31 to move the pressure bar 29 and table 28 up or down.

In operation, the cam 36 turns continuously causing a periodic oscillation of the bell crank 37. The timing is such that as the product being bagged reaches the bottom of the bag, the lobe of the cam 36 moves under the follower 40 pulling down the pressure bar 29 are releasing the lip so the bag can be freely ripped off the wicket 26. The bag support table 28 remains stationary being held up by clutch bar 33. As the bags are progressively removed, the table 28 and pressure bar 29 progressively rise to maintain the top bag at a constant elevation.

As the last bag is removed, its absence is detected whereupon the air cylinder 31 retracts pulling the table 28 and pressure bar 29 down to the lowest position so a new wicket of bags 24 can be transferred into position.

It will be apparent to those skilled in the art from the preceeding description that certain changes may be made in the above apparatus without departing from the scope of the invention. It is intended that the description matter above shall be interpreted as illustrative and in no way limiting, since all equivalents within the scope of the disclosure may be substituted and such substitution is intended.

I claim:

1. A packaging apparatus for successively receiving and packing a supply of material, such as baked goods, into individual bags taken from a stack of bags dispensed from a bag supply means, including: conveyor means for conveying said material into a packaging station; means for causing each of said bags to become partially opened; engaging means for entering and engaging each of said bags for receiving said material to be packaged; advancing means for advancing said material into the interior of said bags for sealing; means sensing the successive utilization of bags from said stack for replenishing bags being used; support means for holding said bags to be dispensed, as required; restraining means disposed in proximity with respect to said bags, for holding said bags in horizontal alignment with respect to said supply of material being inserted therein; drive means for positioning said support means to allow for the withdrawal of said bags from said stack; cam means for advancing said support means into horizontal alignment with product flow after a product inserted bag has been removed from said stack; and means for advancing a fresh stack of packaging material into said packaging station as the last of said bags is utilized.

2. A packaging apparatus for receiving and packing a supply of material, such as baked goods into individual bags taken from a stack of bags dispensed from a bag supply means including: conveying means for conveying said material into a packaging station; means for causing said bag to partially open; engaging means for entering and engaging said bags for receiving said material to be packaged, being defined by a pair of cooperatively acting guide means having elongated body portions for entering into partially opened bags to form a passage area for material to be advanced therethrough and into the package interior; said body portions employing upper and lower elements enabling said engaging means to be generally moved both vertically and horizontally; linkage means for pivotally advancing said elongated body portions to initially converge and subsequently diverge; toggle linkage means connecting said upper and lower elements for defining a line of motion by said elements; biasing means connected to each of said body portions for maintaining such portion biased towards the expanded state as said material is caused to enter and fill said package; advancing means for advancing said material through said engaging means into the interior of said bags for sealing; means sensing the successive utilization of bags from said stack to thereby advance fresh packaging material as said bags are being used; and drive means for advancing a fresh stack of packaging material into said packaging station as the last of said bags is used.

* * * * *